US007629951B2

(12) United States Patent
Wu

(10) Patent No.: US 7,629,951 B2
(45) Date of Patent: Dec. 8, 2009

(54) DISPLAY UNITS

(75) Inventor: Kuan-Long Wu, Mituo Township, Kaohsiung County (TW)

(73) Assignee: Au Optronics Corp., Hsinchu (TW)

( * ) Notice: Subject to any disclaimer, the term of this patent is extended or adjusted under 35 U.S.C. 154(b) by 969 days.

(21) Appl. No.: 11/155,868

(22) Filed: Jun. 20, 2005

(65) Prior Publication Data

US 2006/0253755 A1 Nov. 9, 2006

(30) Foreign Application Priority Data

Apr. 21, 2005 (TW) ..... 94112689 A

(51) Int. Cl.
*G09G 3/32* (2006.01)

(52) U.S. Cl. ..... 345/82; 345/76; 315/169.1

(58) Field of Classification Search ..... 345/76–83; 315/169.1–169.4

See application file for complete search history.

(56) References Cited

U.S. PATENT DOCUMENTS

2003/0107535 A1* 6/2003 Numao ..... 345/76
2004/0056828 A1* 3/2004 Choi et al. ..... 345/82
2004/0140829 A1* 7/2004 Noguchi et al. ..... 326/81
2004/0196221 A1* 10/2004 Shih ..... 345/82
2004/0239600 A1* 12/2004 Lin ..... 345/82
2005/0083270 A1* 4/2005 Miyazawa ..... 345/76
2005/0225518 A1* 10/2005 Yamada et al. ..... 345/77
2005/0285822 A1* 12/2005 Reddy et al. ..... 345/76

FOREIGN PATENT DOCUMENTS

CN 1567409 1/2005

OTHER PUBLICATIONS

CN Office Action mailed Mar. 9, 2007.

* cited by examiner

*Primary Examiner*—Richard Hjerpe
*Assistant Examiner*—Kimnhung Nguyen
(74) *Attorney, Agent, or Firm*—Thomas, Kayden, Horstemeyer & Risley

(57) ABSTRACT

A display unit comprising a first switch unit, a driving unit, a light-emitting unit, and a control circuit. The first switch unit has a control electrode coupled to a scan line, a first electrode coupled to a data line, and a second electrode coupled to a first node. The driving unit has a control electrode coupled to the first node, a first electrode coupled to a first voltage source, and a second electrode coupled to a second node. The light-emitting unit is coupled between the second node and a second voltage source. The control circuit is coupled between the first and second nodes and adjusts a voltage at the first node according to a voltage at the second node.

19 Claims, 4 Drawing Sheets

DISPLAY UNITS

BACKGROUND

The invention relates to a display unit, and in particular to a display unit applied in a display panel.

FIG. 1 is a schematic diagram of a panel of a conventional organic light emitting display (OLED) device. As shown in FIG. 1, a panel 1 comprises a data driver 10, a scan driver 11, and a display array 12. The data driver 10 controls a plurality of data lines $D_1$ to $D_n$ and the scan driver 11 controls a plurality of scan lines $S_1$ to $S_m$. The display array 12 is formed by interlaced data lines $D_1$ to $D_n$ and scan lines $S_1$ to $S_m$. Each interlaced data line and scan line corresponds to one display unit, for example, interlaced data line $D_1$ and scan line $S_1$ correspond to display unit 100. As with any other display unit, the equivalent circuit of the display unit 100 comprises a switch transistor T10, a storage capacitor. C10, a driving transistor T11, and a light-emitting diode D10.

The scan driver 11 sequentially outputs scan signals to scan lines $S_1$ to $S_m$ to turn on the switch transistors within all display units corresponding to one row and turn off the switch transistors within all display units corresponding to all other rows. The data driver 10 outputs data signals with gray-scale values to the display units corresponding to one row through the data lines $D_1$ to $D_n$ according to prepared image data but not yet displayed. For example, when the scan driver 11 outputs a scan signal to the scan line $S_1$, the switch transistor T10 is turned on, and the data driver 10 outputs a corresponding data signal SD to the display unit 100 through the data line $D_1$. At this time, a voltage at a node N10 is equal to voltage vdata of the data signal SD. The driving transistor T11 is turned on according to the voltage at the node N10 and provides a driving current Id to drive the LED D10 to emit light.

In an OLED device, with the increment of the light-emitting time of the LED D10, the brightness of the LED D10 is lowered for the same data signal SD. In other words, when each display unit of the panel 1 displays an image of the same brightness, the display units, lit for a long time, have lower brightness than the display units, only recently lit. Thus, brightness of the image on panel 1 is not uniform resulting in sticking image.

SUMMARY

An exemplary embodiment of a display unit comprises a first switch unit, a driving unit, a light-emitting unit, and a control circuit. The first switch unit has a control electrode coupled to a scan line, a first electrode coupled to a data line, and a second electrode coupled to a first node. The driving unit has a control electrode coupled to the first node, a first electrode coupled to a first voltage source, and a second electrode coupled to a second node. The light-emitting unit is coupled between the second node and a second voltage source. The control circuit is coupled between the first and second nodes and adjusts a voltage at the first node according to a voltage at the second node.

An exemplary embodiment of a display unit comprises a first transistor, a second transistor, a light-emitting unit, and a control circuit. The first transistor has a control terminal coupled to a scan line, an input terminal coupled to a data line, and an output terminal coupled to a first node. The data line provides a specific data signal with a data voltage. The second transistor has a control terminal coupled to the first node, an input terminal coupled to a first voltage source, and an output terminal coupled to a second node. The light-emitting unit is coupled between the second node and a second voltage source. The control circuit is coupled between the first and second nodes. In a first period, a voltage at the first node is equal to the data voltage, and a voltage at the second is equal to a first voltage. In a second period, the voltage at the second node is changed to a second voltage, and the control circuit changes the voltage at the first node from the data voltage to a third voltage according to variation of the voltage at the second node.

DESCRIPTION OF THE DRAWINGS

The invention will become more fully understood from the detailed description given herein below and the accompanying drawings, given by way of illustration only and thus not intended to be limitative of the invention.

DETAILED DESCRIPTION

Figure 1:
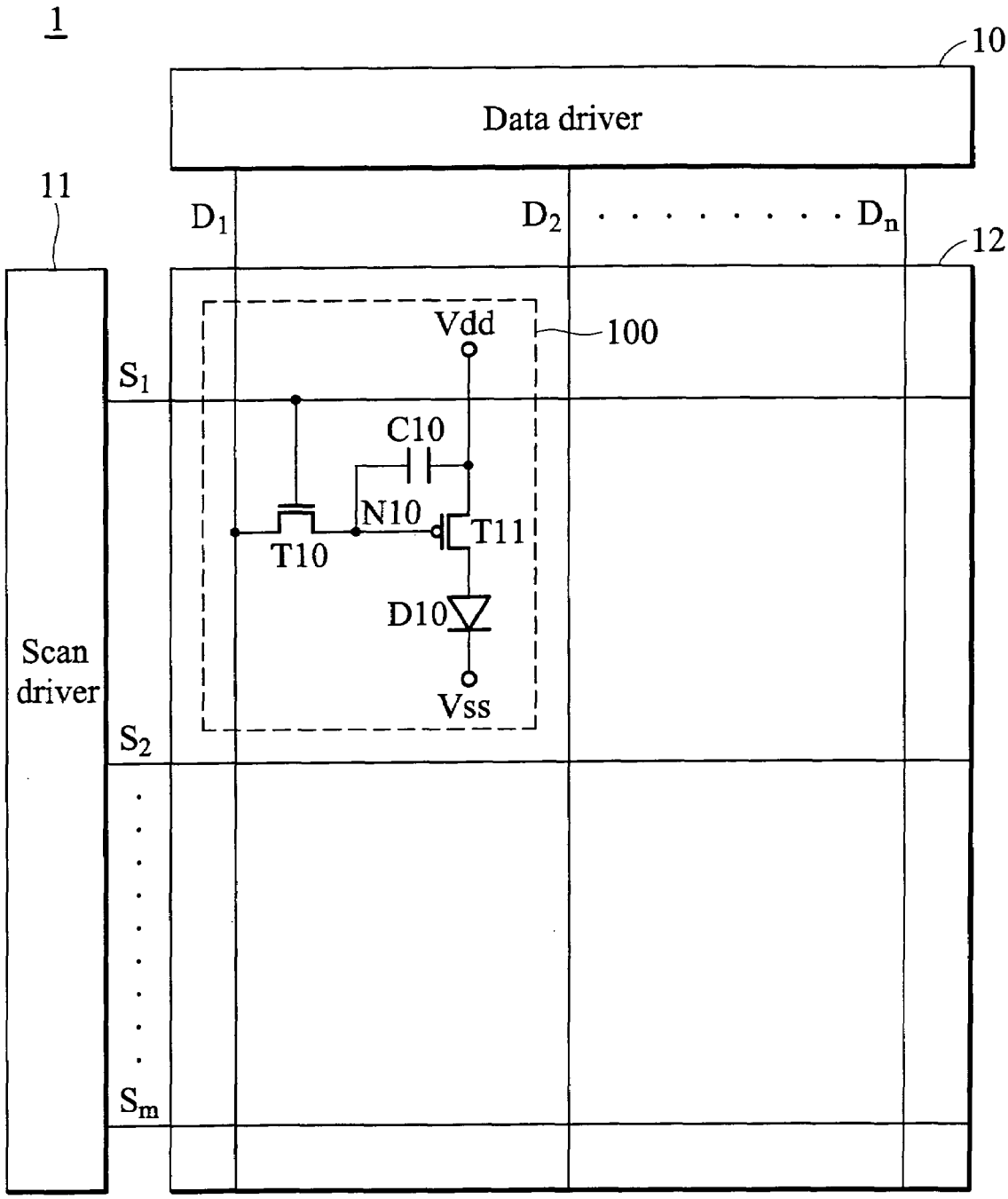
FIG. 1 (RELATED ART)
FIG. 1 is a schematic diagram of a panel of a conventional organic light emitting display device.
Figure 2:
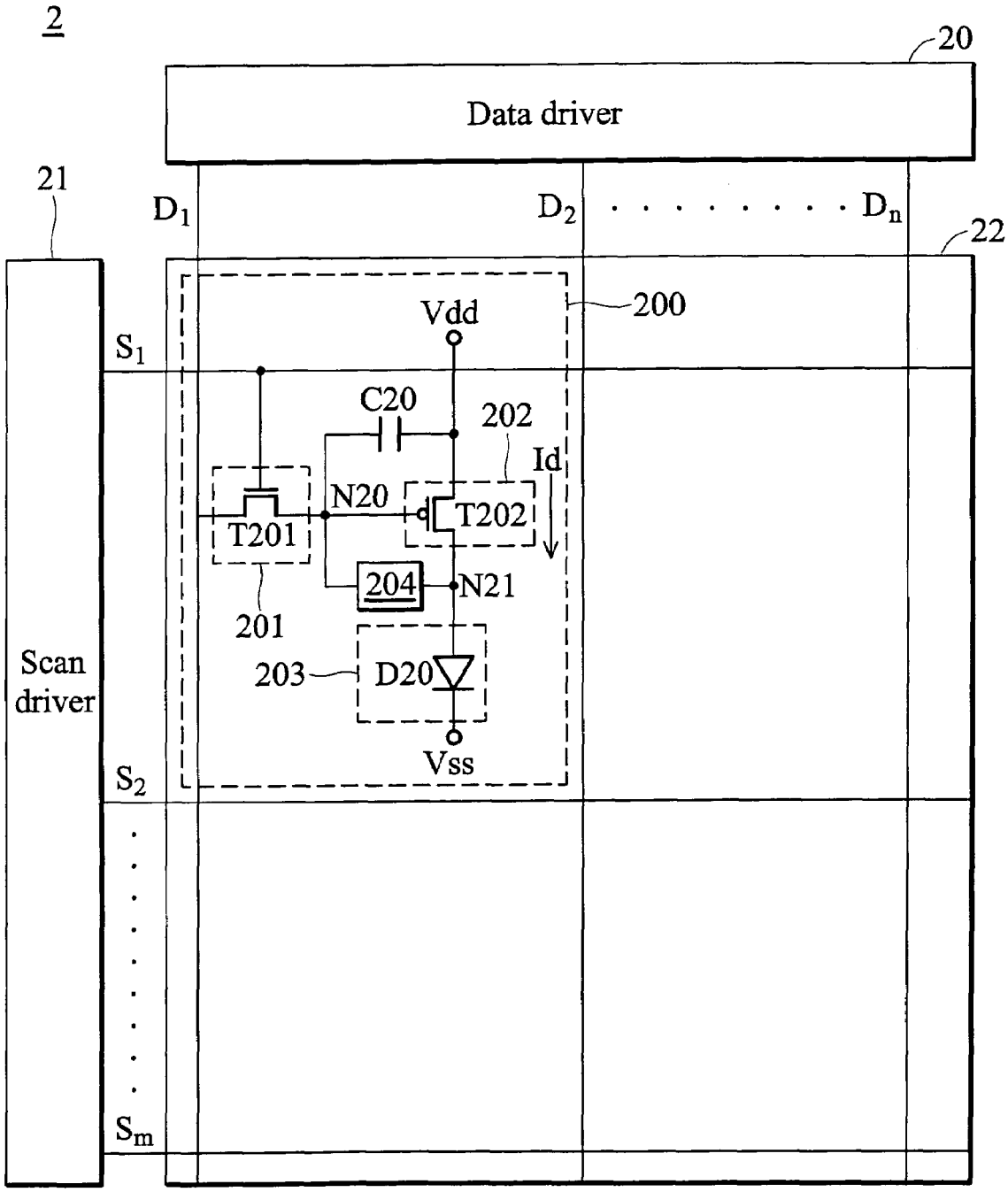
FIG. 2 depicts an embodiment of a panel of a display device.

In an exemplary embodiment of a panel of a display device, as shown in FIG. 2, a panel 2 comprises a data driver 20, a scan driver 21, and a display array 22. The data driver 20 controls a plurality of data lines $D_1$ to $D_n$ and the scan driver 21 controls a plurality of scan lines $S_1$ to $S_m$. The display array 22 is formed by interlaced data lines $D_1$ to $D_n$ and scan lines $S_1$ to $S_m$. The interlaced data line and scan line correspond to one display unit, for example, interlaced data line $D_1$ and scan line $S_1$ correspond to display unit 200. As with any other display unit, the equivalent circuit of the display unit 200 comprises a switch unit 201, a storage capacitor C20, a driving unit 202, a light-emitting unit 203, and a control circuit 204. In this embodiment, the switch unit 201 comprises an NMOS transistor T201. A gate (control terminal), a drain (input terminal), and a source (output terminal) of the NMOS transistor T201 are respectively coupled to a control electrode, a first electrode, and a second electrode of the switch unit 201. The driving unit 202 comprises a PMOS transistor T202. A gate (control terminal), a source (input terminal), and a drain (output terminal) of the PMOS transistor T202 are respectively coupled to a control electrode, a first electrode, and a second electrode of the driving unit 202. The light-emitting unit 203 comprises a light-emitting diode (LED) D20, a current-driven element.

The gate of the transistor T201 is coupled to the scan line $S_1$, the drain thereof is coupled to the data line $D_1$, and the source thereof is coupled to a node N20. The gate of the transistor T202 is coupled to the node N20, the source thereof is coupled to a voltage source Vdd, and the drain thereof is coupled to a node N21. The LED D20 is coupled between the node N21 and a voltage source Vss. The storage capacitor C20 is coupled between the voltage source Vdd and the node N20. The control circuit 204 is coupled between the nodes N20 and N21.

As described, with the increment in the light-emitting time of the LED D20, the current brightness of the LED D20 is not equal to the previous brightness thereof for the same specific data signal provided by the data line $D_1$. Especially, at the same time, the cross voltage of the LED D20 is increased, that is, a voltage at the node N21 is increased.

In some embodiments, the control circuit 204 is used to adjust a voltage at the node N20 according to a voltage at the node N21. When the data line $D_1$ provides the same data signal SD to the display unit 200 in frames, with the increment of the light-emitting time of the LED D20, the brightness of the LED D20 is lowered, and the voltage at the node N21 is increased. The control circuit 204 decreases the voltage at the node N20. At this time, a source-gate voltage vsg of the transistor T202 is increased, and a driving current provided from the transistor T202 is increased, so that the brightness of the LED D20 is increases. The lost brightness of the LED D20 is thus compensated.

Figure 3:
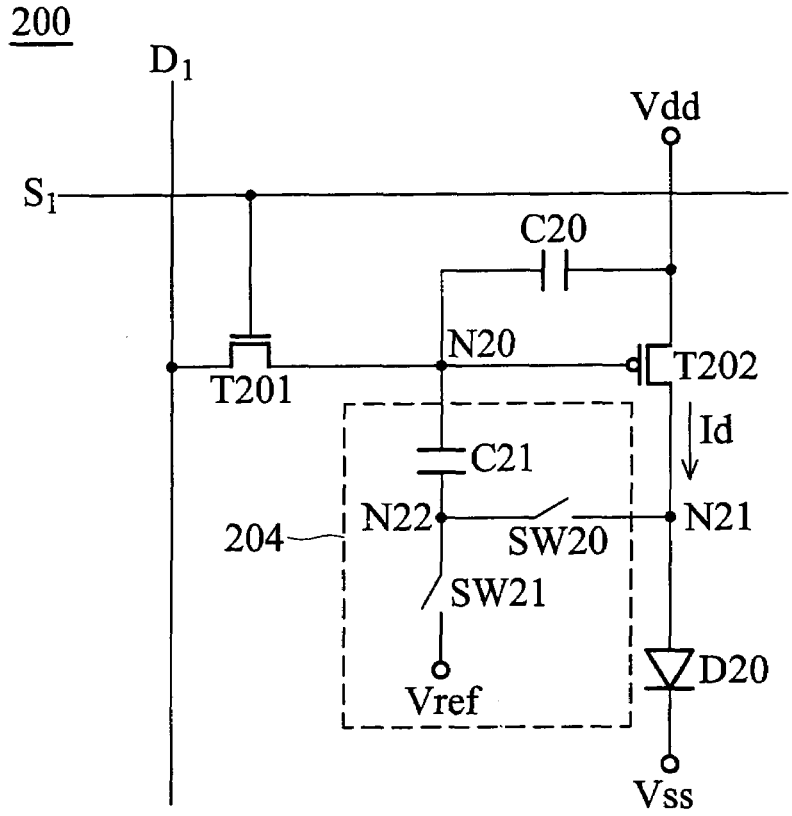
FIG. 3 depicts an embodiment of a display unit of the panel in FIG. 2.

In an exemplary embodiment of a control circuit of the display unit 200, as shown in FIG. 3, a control circuit 204 comprises a capacitor C21 and switch units SW20 and SW21. The switch unit SW20 is coupled between the nodes N22 and N21, and the switch unit SW21 is coupled between the node N22 and the reference voltage source Vref. The capacitor C21 is coupled between the nodes N20 and N22.

Figure 4:
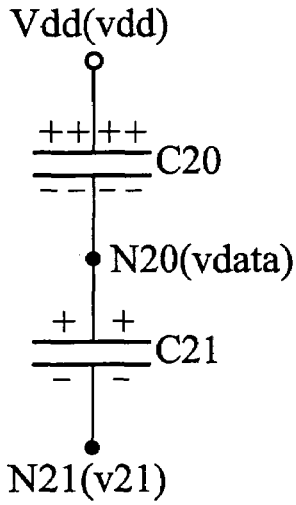
FIG. 4 depicts the charges of the capacitors in FIG. 3.

In a frame, during a first period, when the data driver 20 is to provide a data signal SD to the display unit 200, the transistor T201 and the switch unit SW20 are turned on, and the switch unit SW21 is turned off. The voltage at the node N20 is equal to a voltage vdata of the data signal SD. The transistor T202 is turned on according to the voltage at the node N20 and generates a driving current Id to drive the LED D20 to emit light. Referring to FIG. 4, the number of charges stored by the capacitors C20 and C21 is determined by the voltage of the voltage source Vdd, the voltage vdata of the data signal SD, and the voltage at the node N21.

During a second period following the first period, the transistor T201 and the switch unit SW20 are turned off, while the switch unit SW21 is turned on. At this time, the voltage at the node N20 is, according to charge conservation:

$$v20 = \frac{c1 * vdata + c2 * (vdata - v21 + vref)}{c1 + c2} \quad \text{(Formula 1)}$$

wherein v20 represents the voltage at node N20, v21 represents the voltage at the node N21, vref represents the voltage provided by the voltage source Vref, and c1 and c2 are respectively represent values of the capacitors. C20 and C21. In formula 1, vref, c1, and c2 are predetermined constants.

When the brightness of the LED D20 is lowered with the increment of the light-emitting time of the LED D20, the voltage v21 at the node N21 is increased. According to formula 1, in later frames, when the voltage v21 at the node N21 is increased (from a first voltage to a second voltage), the voltage v20 at node N20 is decreased (from voltage vdata to a third voltage). For the transistor T202, the voltage v20 is decreased, and the source-gate voltage vsg of the transistor T202 is increased. The transistor T202 thus provides higher driving current Id, increasing the brightness of LED D20, solving the problem of sticking image.

According to Equation 1, when the voltage v21 at the node N21 is increased, the voltage v20 at node N20 is decreased. The variation of the voltage v20 is determined by the variation of the voltage v21 and the ratio of the capacitances c1 to c2. In other words, the variation of the voltage v21 provides different voltage feedback to the voltage v20 by determining different ratios of the capacitances c1 to c2.

Moreover, in some embodiments, if the variations of the voltages v20 and v21 are to be the same, the capacitor C20 is omitted. By simplifying Equation 1, the voltage v20 is given by:

$$v20 = vdata - v21 + vref \quad \text{(Formula 2)}$$

According to formula 2, the variation of the voltage v21 is equal to that of the voltage v20. For example, when the voltage v21 is increased 1V, the voltage v20 is decreased 1V.

Figure 5:
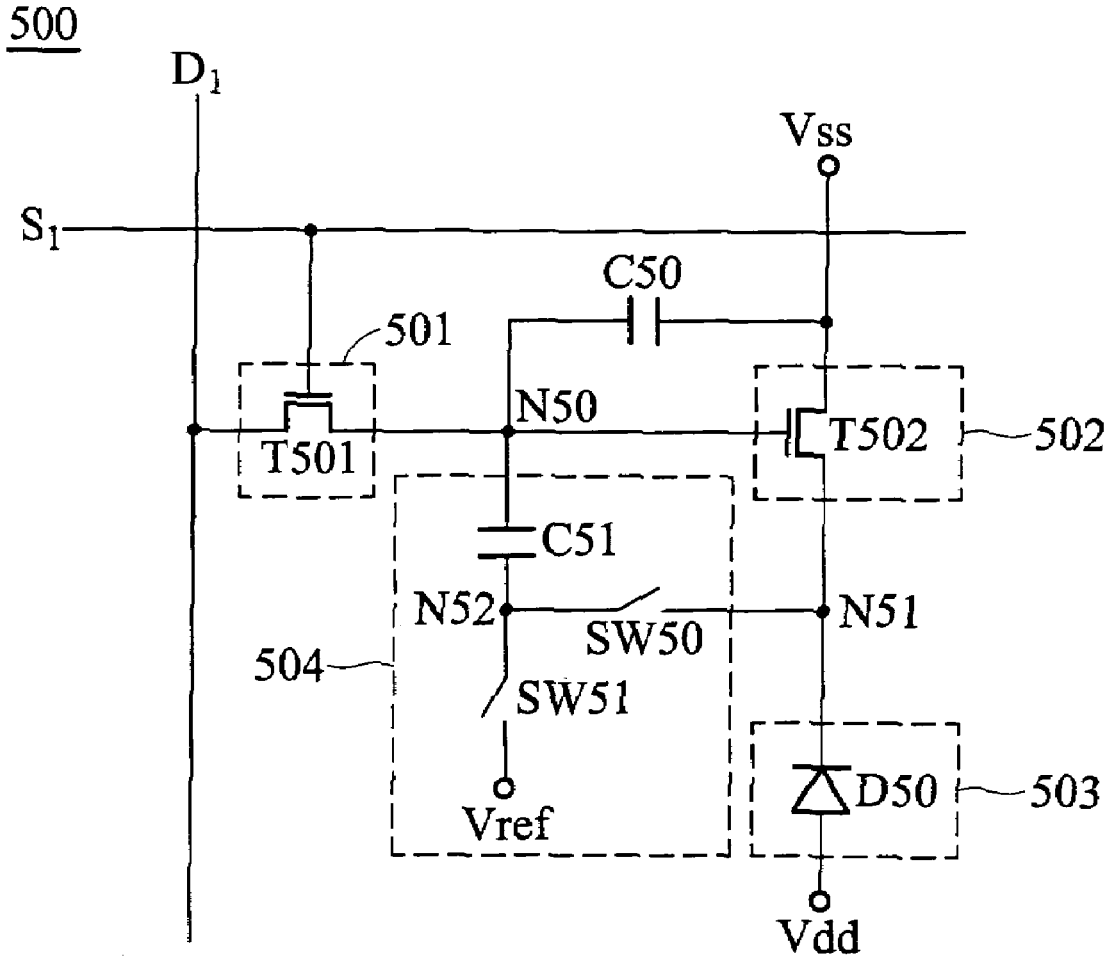
FIG. 5 depicts an embodiment of a display unit of the panel in FIG. 2.

In an exemplary embodiment of a display unit of panel 2, shown in FIG. 5, an equivalent circuit of a display unit 500 comprises a switch unit 501, a storage capacitor C50, a driving unit 502, a light-emitting unit 503, and a control circuit 504. In this embodiment, the switch unit 501 comprises an NMOS transistor T501. A gate (control terminal), a drain (input terminal), and a source (output terminal) of the NMOS transistor T501 are respectively coupled to a control electrode, a first electrode, and a second electrode of the switch unit 501. The driving unit 502 comprises an NMOS transistor T502. A gate (control terminal), a drain (input terminal), and a source (output terminal) of the NMOS transistor T502 are respectively coupled to a control electrode, a first electrode, and a second electrode of the driving unit 502. The light-emitting unit 503 comprises a light-emitting diode (LED) D50, a current-driven element.

The gate of the transistor T501 is coupled to the scan line $S_1$, the drain thereof is coupled to the data line $D_1$, and the source thereof is coupled to a node N50. The gate of the transistor T502 is coupled to the node N50, the source thereof is coupled to a voltage source Vss, and the drain thereof is coupled to a node N51. The LED D50 is coupled between the node N51 and a voltage source Vdd. The storage capacitor C50 is coupled between the voltage source Vss and the node N50. The control circuit 504 is coupled between the nodes N50 and N51.

The control circuit 504 comprises a capacitor C51 and switch units SW50 and SW51. The switch unit SW50 is coupled between the nodes N52 and N51, and the switch unit SW51 is coupled between the node N52 and the reference voltage source Vref. The capacitor C51 is coupled between the nodes N50 and N52. In a frame, during a first period, the transistor T501 and the switch unit SW50 are turned on, and the switch unit SW51 is turned off. During a second period following the first period, the transistor T501 and the switch unit SW50 are turned off, while the switch unit SW51 is turned on.

As described above, with the increment of the light-emitting time of the LED D50, the brightness of the LED D50 is lowered, and a voltage at the node N51 decreased. The control circuit 504 adjusts a voltage at the node N50 according to the variation of the voltage at the node N51. Thus, the transistor T502 provides a larger driving current, increasing the brightness of the LED D50, solving the problem of sticking image.

While the invention has been described in terms of preferred embodiment, it is to be understood that the invention is not limited thereto. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A display unit for a display device, comprising:

a first switch unit comprising a control electrode coupled to a scan line, a first electrode coupled to a data line, and a second electrode coupled to a first node;

a driving unit comprising a control electrode coupled to the first node, a first electrode coupled to a first voltage source, and a second electrode coupled to a second node;

a light-emitting unit coupled between the second node and a second voltage source; and a control circuit, coupled between the first and second nodes, wherein when a voltage at the second node is changed, the control unit adjusts a voltage at the first node.

2. The display unit as claimed in claim 1, wherein the data line is adapted to provide a specific data signal with a data voltage to the first node, and when the voltage at the second node is changed from a first voltage to a second voltage, the control circuit changes the voltage at the first node from the data voltage to a third voltage.

3. The display unit as claimed in claim 2, wherein the variation from the data voltage to the third voltage is substantially equal to that from the first voltage to the second voltage.

4. The display unit as claimed in claim 2, wherein the control circuit comprises:

a second switch unit coupled between the second node and a third node;

a third switch coupled between the third node and a reference voltage source; and a first capacitor coupled between the first and third nodes.

5. The display unit as claimed in claim 4, wherein, in a frame, during a first period, the first and second switches are turned on, and the third switch unit is turned off; and wherein, during a second period following the first period, the first and second switches are turned off, and the third switch unit is turned on.

6. The display unit as claimed in claim 5, wherein the voltage at the first node is substantially equal to the data voltage during the first period, and the voltage at the first node is changed from the data voltage to the third voltage during the second period.

7. The display unit as claimed in claim 1, further comprising a first capacitor coupled between the first voltage source and the first node.

8. The display unit as claimed in claim 7, wherein the data line is adapted to provide a specific data voltage to the first node, and when the voltage at the second node is changed from a first voltage to a second voltage, the control circuit charges the voltage at the first node from the specific data voltage to a third voltage.

9. The display unit as claimed in claim 8, wherein the control circuit comprises:

a second switch unit coupled between the second node and a third node;

a third switch coupled between the third node and a reference voltage source; and a second capacitor coupled between the first and third nodes.

10. The display unit as claimed in claim 9, wherein the variation of the voltage at the first node is determined by the variation of the voltage at the second node and the ratio of value of the first capacitor to the value of the second capacitor.

11. The display unit as claimed in claim 9, wherein, in a frame, during a first period, the first and second switches are turned on, and the third switch unit is turned off; and wherein, during a second period following the first period, the first and second switches are turned off, and the third switch unit is turned on.

12. The display unit as claimed in claim 11, wherein the voltage at the first node is substantially equal to the specific data voltage during the first period, and the voltage at the first node is changed from the specific data voltage to the third voltage during the second period.

13. The display unit as claimed in claim 1, wherein the driving unit comprises a P-type transistor, the first voltage source is configured to provide a high voltage, and the second voltage source is configured to provide a low voltage.

14. The display unit as claimed in claim 1, wherein the driving unit comprises an N-type transistor, the first voltage source is configured to provide a low voltage, and the second voltage source is configured to provide a high voltage.

15. A display unit for a display device, comprising:

a first transistor comprising a control terminal coupled to a scan line, an input terminal coupled to a data line, and an output terminal coupled to a first node, wherein the data line provides a specific data signal with a data voltage;

a second transistor comprising a control terminal coupled to the first node, an input terminal coupled to a first voltage source, and an output terminal coupled to a second node;

a light-emitting unit coupled between the second node and a second voltage source; and a control circuit coupled between the first and second nodes;

wherein, in a first period, a voltage at the first node is substantially equal to the data voltage, and a voltage at the second node is substantially equal to a first voltage; and wherein, in a second period, the voltage at the second node is changed to a second voltage, and the control circuit changes the voltage at the first node from the data voltage to a third voltage according to variation of the voltage at the second node.

16. The display unit as claimed in claim 15, wherein the variation of the voltage at the first node is substantially equal to the variation of the voltage at the second node.

17. The display unit as claimed in claim 15, wherein the control circuit comprises:

a first switch unit coupled between the second node and a third node;

a second switch coupled between the third node and a reference voltage source; and a first capacitor coupled between the first and third nodes.

18. The display unit as claimed in claim 17 further comprising a second capacitor coupled between the first voltage source and the first node.

19. The display unit as claimed in claim 15, wherein the variation of the voltage at the first node is determined by the variation of the voltage at the second node and the ratio of value of the first capacitor to the value of the second capacitor.

* * * * *